US007658309B2

(12) United States Patent
Jang

(10) Patent No.: US 7,658,309 B2
(45) Date of Patent: Feb. 9, 2010

(54) NAIL PRESSER LID STRUCTURE FOR A NAILER

(75) Inventor: Jen-Fang Jang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/676,296

(22) Filed: Feb. 18, 2007

(65) Prior Publication Data

US 2007/0205246 A1 Sep. 6, 2007

(30) Foreign Application Priority Data

Mar. 3, 2006 (TW) ..... 95107326 A

(51) Int. Cl.
*B25C 5/02* (2006.01)

(52) U.S. Cl. ..... 227/123; 227/127; 227/128; 227/135; 227/136; 227/137; 227/120

(58) Field of Classification Search ..... 227/123, 227/127, 128, 135, 136, 137, 120
See application file for complete search history.

(56) References Cited

U.S. PATENT DOCUMENTS 3,543,987 A * 12/1970 Obergfell et. al. ..... 227/136
3,703,981 A * 11/1972 Smith ..... 227/136
5,683,024 A * 11/1997 Eminger et al. ..... 227/8
5,772,098 A * 6/1998 Crutcher ..... 227/119
6,308,880 B1 * 10/2001 Ronconi ..... 227/119
D466,781 S * 12/2002 Matsuoka et al. ..... D8/69
D491,035 S * 6/2004 Buck ..... D8/68
D505,608 S * 5/2005 Arai et al. ..... D8/68
D518,698 S * 4/2006 Thomas et al. ..... D8/69
7,137,186 B2 * 11/2006 Wojcicki et al. ..... 29/592
7,234,623 B2 * 6/2007 Li ..... 227/137
2005/0023323 A1 * 2/2005 Jalbert et al. ..... 227/137
2007/0090148 A1 * 4/2007 Cho et al. ..... 227/137

* cited by examiner

*Primary Examiner*—Rinaldi I. Rada
*Assistant Examiner*—Michelle Lopez
(74) *Attorney, Agent, or Firm*—Egbert Law Offices PLLC

(57) ABSTRACT

The nail presser lid structure for a nailer includes a coupling end and a swinging end. The swinging end is provided with a flexible presser, formed of a presser portion and a spring. The presser portion protrudes from the swinging end to press on the closing side of the removable cover. An inclined guide plane is placed outside of the presser portion. When the removable cover presses the inclined guide plane, the presser portion is forced to return and press the spring to accumulate elastic restoring force. When the closing side of the removable cover overpasses the inclined guide plane, the presser portion will recover again and press the positioning portion of the closing side, such that the nail presser lid and removable cover of the nail box are closed flexibly, offering greater operational friendliness and practicability.

6 Claims, 11 Drawing Sheets

NAIL PRESSER LID STRUCTURE FOR A NAILER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a structure for a nailer, and more particularly to an innovative nail presser lid structure for a nailer.

2. Description of Related Art Including Information Disclosed Under 37 CFR 1.97 and 37 CFR 1.98.

The collated nails of a common nailer are guided from a nail box to an outlet. The collated nails are also pressed by a nail presser lid. The nail presser lid is opened or closed by a axially rotating the nail presser lid. The removable cover of the nail box can be overlapped and positioned when the nail presser lid is closed.

FIG. 1 depicts the typical configuration of the nail presser lid and the removable cover of the nail box. The typical closing sequence is to first close the removable cover 11 of nail box 10, and then the nail presser lid 20. So, a recessed surface 12 is formed at the closed end of the removable cover 11 for insertion of swinging end 21 of the nail presser lid 20. The fixed end of the nail presser lid 20 is also positioned when closed. If the closing sequence is reversed by closing the nail presser lid 20 first and then the removable cover 11, then it is impossible to overlap the nail presser lid 20 and removable cover 11, leading to incorrect positioning of the lid and cover and inconvenience during operation of the nailer.

From another viewpoint, the typical structure only allows closure of the removable cover 11 first and then the nail presser lid 20 second. The operator may pull the collated nails 22 towards the outlet 23 until reaching the section 24 corresponding to nail presser lid 20. Then, the removable cover 11 of nail box 10 is closed. However it can be important to close the nail presser lid 20 first for purposes of correct alignment because the head section 221 of collated nails 22 is pressed and positioned by nail presser lid 20 at the outlet. Since one end of collated nails 22 facing the nail box 10 is already shielded by the removable cover 11, the misalignment may not be detected when the nail presser lid 20 is closed second. The probability of misalignment of the collated nails 22 increases markedly when the operator closes the nail presser lid 20, thus affecting the accuracy and smoothness of nailing behavior. The closed removable cover 11 does not allow the user to detect this misalignment.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

A major purpose of the nail presser lid A of the present invention is to provide a flexible presser 60 such that the nail presser lid A and removable cover 41 of nail box 40 are closed flexibly. When the removable cover 41 is closed first, and the nail presser lid A is closed second, then the presser portion 61 of flexible presser 60 directly presses onto positioning portion 412 of the closed side 411 of the removable cover 41 for overlapping and positioning. When the nail presser lid A is closed first, and the removable cover 41 is closed second, the removable cover 41 presses the inclined guide plane 63 of the flexible presser 60. The presser portion 61 returns and presses the spring 62 to accumulate an elastic restoring force. When the closing side of the removable cover 41 overlaps the inclined guide plane 63, the presser portion 61 recovers again and presses the positioning portion 412 of the closed side 411 of the removable cover 41. As such, the removable cover 41 and nail presser lid A are flexibly overlapped and positioned.

Based on this innovative flexible presser, the present invention features greater flexibility, more convenience, and greater practicability, since it has overcome the prior art problem of a limited closing sequence. Furthermore, since the nail presser lid A can now be closed first, it is possible to press down and securely position the collated nails at the outlet, thereby ensuring accuracy and alignment of loading the collated nails.

The present invention also includes a wear-resistant presser disc 80 built into a preset location on an inner surface 53 of the nail presser lid A. The wear-resistant presser disc 80 forms a solid contact surface, so that the nail presser lid A may be made of plastics, while the wear-resistant presser disc 80 is made of metal. With the metal wear-resistant presser disc 80, the present invention significantly reduces the percentage of metal in the nail presser lid A. The present invention resolves the prior art problems of a nail presser lid having heavier weight, higher manufacturing costs and additional processing efforts. Moreover, plastic nail presser lid A contributes to mass production, making it possible to shorten the manufacturing process without need of secondary processing.

The present invention also retains the option of opening the nail presser lid A first. If the user intends to open the nail presser lid A first, then the switch knob 71 of the positioning member 70 is pulled upwards, such that the snapper 72 is forced to swing downwards and separate from the hook 32 of nailer body 30, as shown in FIG. 7. Thus, it is now possible to open the nail presser lid A first. It can thus be seen that, the nail presser lid A of the present invention and the removable cover 41 of the nailer body 30 are not limited to a particular sequence, offering more operational friendliness and ease-of-operation.

Although the invention has been explained in relation to its preferred embodiment, it is to be understood that many other possible modifications and variations can be made without departing from the spirit and scope of the invention as hereinafter claimed. For example, switching the flexible presser 60 of the swinging end 52 of nail presser lid A onto the removable cover 41 of the nail box 40 and switching the positioning portion 412 on the closed side 411 of the removable cover 41 to the swinging end 52 of nail presser lid A for the same purpose is within the scope of the claims. Such modifications and variations are contained in the claims.

DETAILED DESCRIPTION OF THE INVENTION

Figure 1:
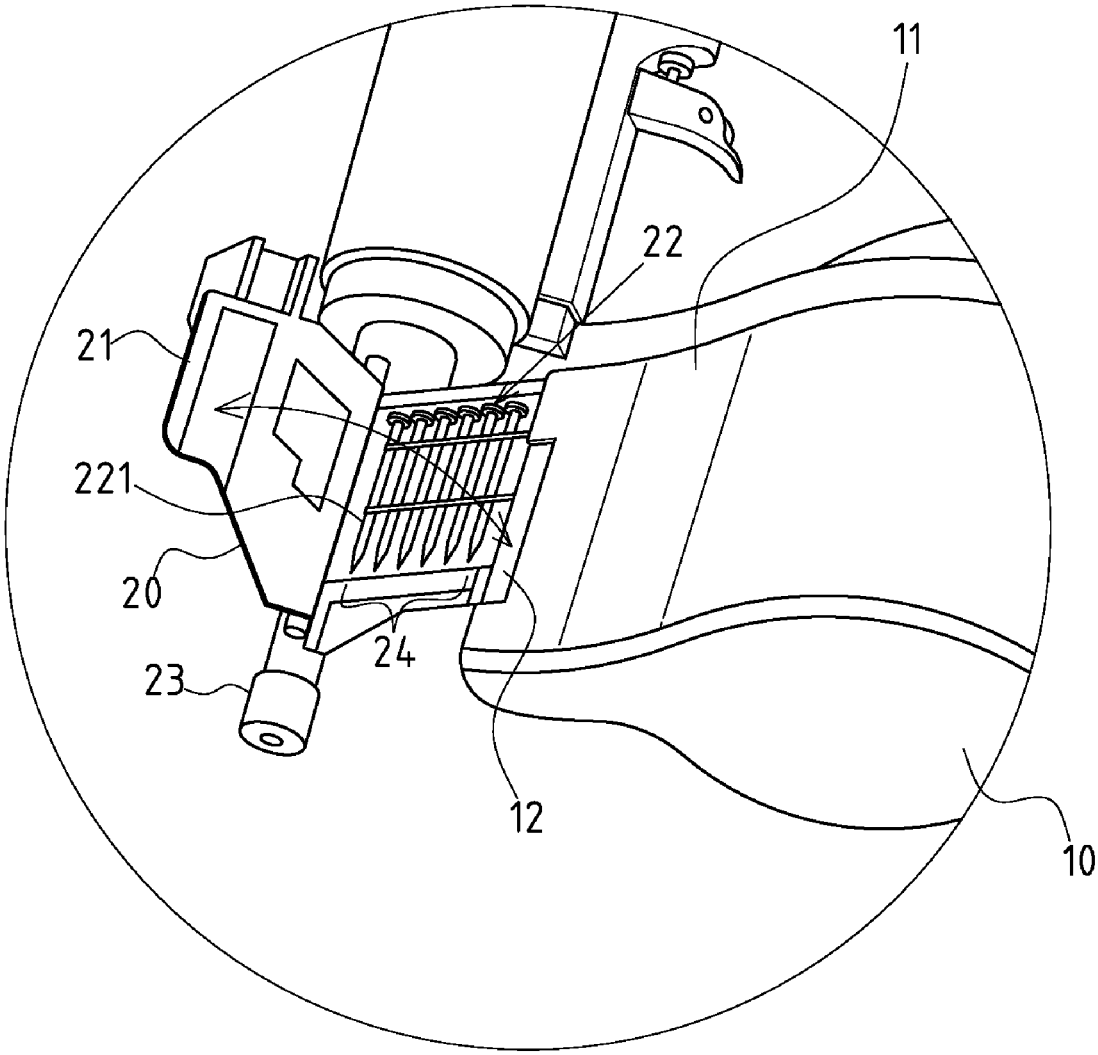
FIG.1 PRIOR ART
FIG. 1 shows an isolated perspective view of a typical nail presser lid structure.

The features and the advantages of the present invention will be more readily understood upon a thoughtful deliberation of the following detailed description of a preferred embodiment of the present invention with reference to the accompanying drawings.

FIGS. 1, 2, 3, 4, and 5 depict preferred embodiments of a nail presser lid structure for a nailer. The nailer includes a nailer body 30, a nailing portion 31 at a preset end of nailer body 30, and a nail box 40 at the other end of the nailer body 30. Collated nails are accommodated within the nail box 40, and a removable cover 41 is placed outside of nail box 40. A closing side 411 is set at one side of removable cover 41 facing the nailing portion 31. The nail presser lid A is mounted between nailing portion 31 of nailer body 30 and closing side 411 of removable cover 41 of the nail box 40.

The nail presser lid A includes a coupling end 51, which is placed at a preset location of the nailing portion 31 of the nailer body 30. The coupling end 51 of the preferred embodiment is fixed onto a coupling seat 310 at one side of the nailing portion 31 via a shaft bolt 510.

The nail presser lid A also includes a swinging end 52, which is placed at the other end of coupling end 51. The swinging end 52 can swing by taking the coupling end 51 as a pivot point to form the opening or closing of nail presser lid A.

An inner surface 53 is placed at one side of the nail presser lid A facing the nailer body 30. The inner surface 53 of the preferred embodiment is provided with two interval grooves 54 to accommodate two claws 55 and bracing spring 56. As an existing member, the claw 55 is obliquely snapped at the collated nail to avoid return of collated nail towards the nail box 40.

Figure 5:
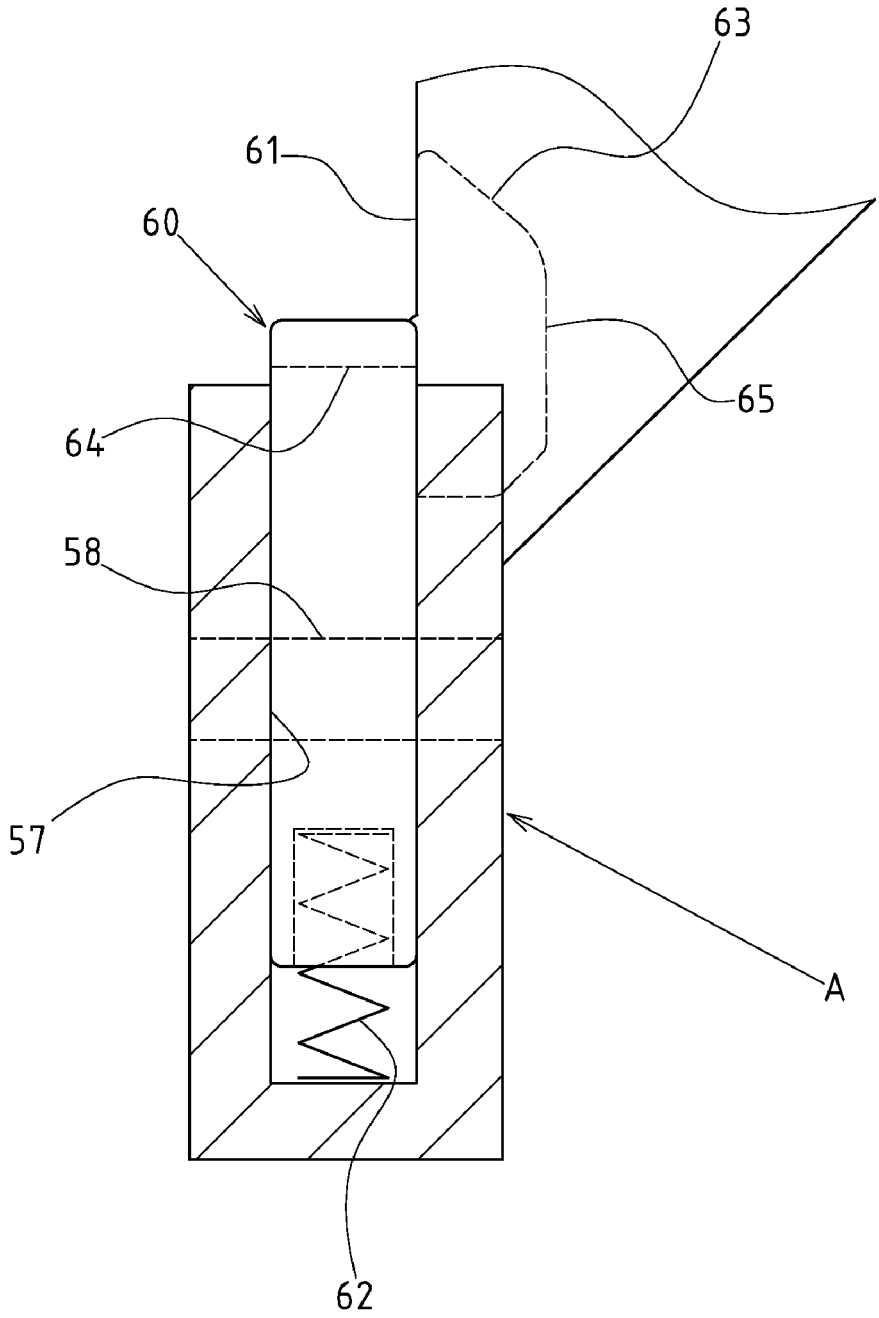
FIG. 5 shows a partial sectional view of the nail presser lid of the present invention.

A flexible presser 60 is flexibly installed at the swinging end 52 of nail presser lid A. The flexible presser 60 comprises a presser portion 61 and a spring 62 used to recover the presser portion 61 to a normal position. The presser portion 61 protrudes from the swinging end 52 and presses at a preset positioning portion 412 of the closing side 411 of removable cover 41, as a recessed surface in this preferred embodiment. An inclined guide plane 63 and a dialing portion 65 are placed outside of the presser portion 61. The dialing portion 65 extends to the lower part of inclined guide plane 63 for manual dialing. The flexible presser 60 of the preferred embodiment may be a vertical sliding block, such that a vertical chute 57 can be set at swinging end 52 of nail presser lid A to accommodate the flexible presser 60. The spring 62 is mounted between the flexible presser 60 and bottom of vertical chute 57, while the flexible presser 60 is provided with a transverse long spacing hole 64. Thus, it is possible to pass through the long spacing hole 64 via a pin 58 in the vertical chute 57, as shown in FIG. 5, such that the shift of the flexible presser 60 is limited.

Figure 6:
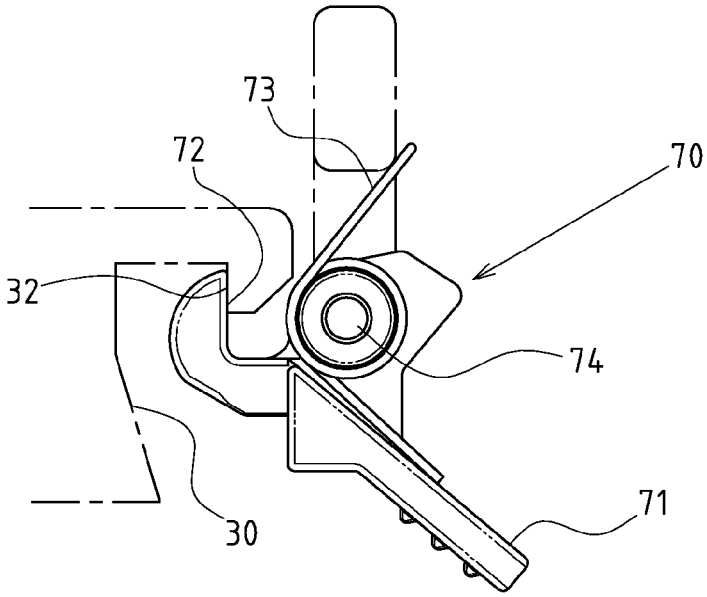
FIG. 6 shows a schematic view of the preferred embodiment of the positioning member of the present invention in a first position.
Figure 7:
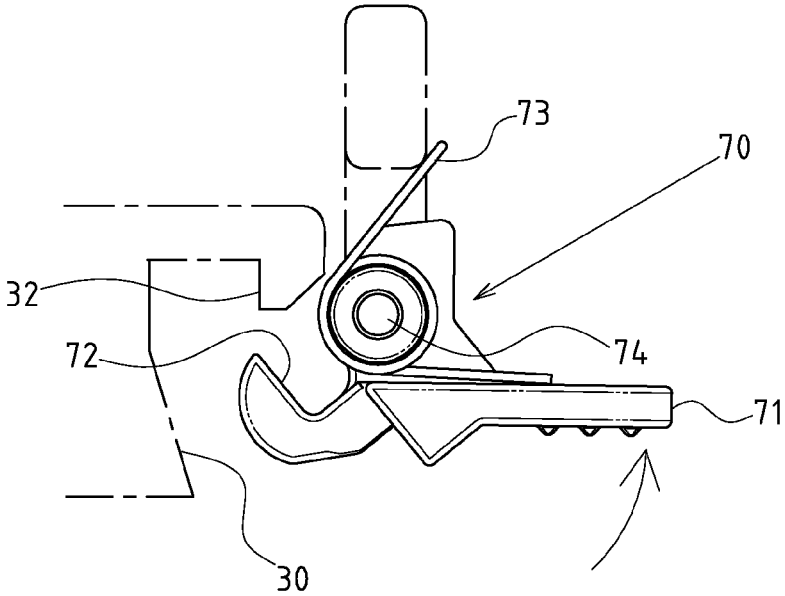
FIG. 7 shows another schematic view of the preferred embodiment of the positioning member of the present invention in a second position.

A positioning member 70 is placed at a preset location of nail presser lid A such that nail presser lid A in a closed state can be positioned. The positioning member 70 of the preferred embodiment may be available with a swinging pattern. The positioning member comprises a switch knob 71, a snapper 72 and a torsion spring 73. The snapper 72 is placed at one end of switch knob 71. The positioning member 70 could be installed at a preset location of the swinging end of nail presser lid A via a transverse shaft bolt 74. The positioning member 70 is operated as shown in FIG. 6. In general, the positioning member 70 enables the snapper 72 to swing upwards via the tension of torsion spring 73. Then, the positioning member 70 is fixed at opposite hook 32 of the nailer body 30, thus achieving positioning of nail presser lid A in a closed state. Referring also to FIG. 7, when the switch knob 71 is pulled upwards, the snapper 72 is forced to swing downwards and then separate from the hook 32 of the nailer body 30, thereby opening the nail presser lid A.

Based upon above-specified structures, the nail presser lid of the present invention operates as described herein.

Figure 2:
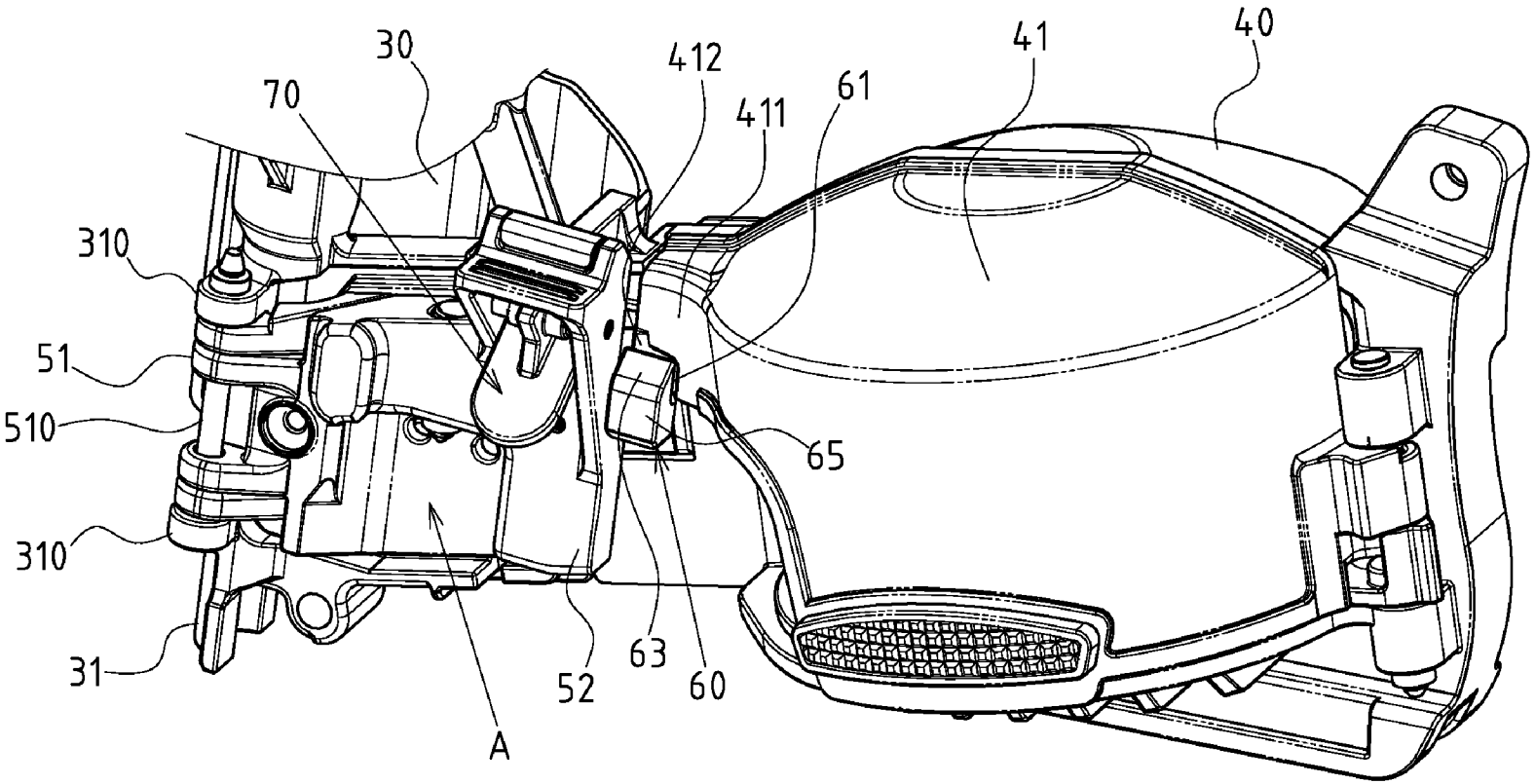
FIG. 2 shows an assembled perspective view of the present invention.
Figure 3:
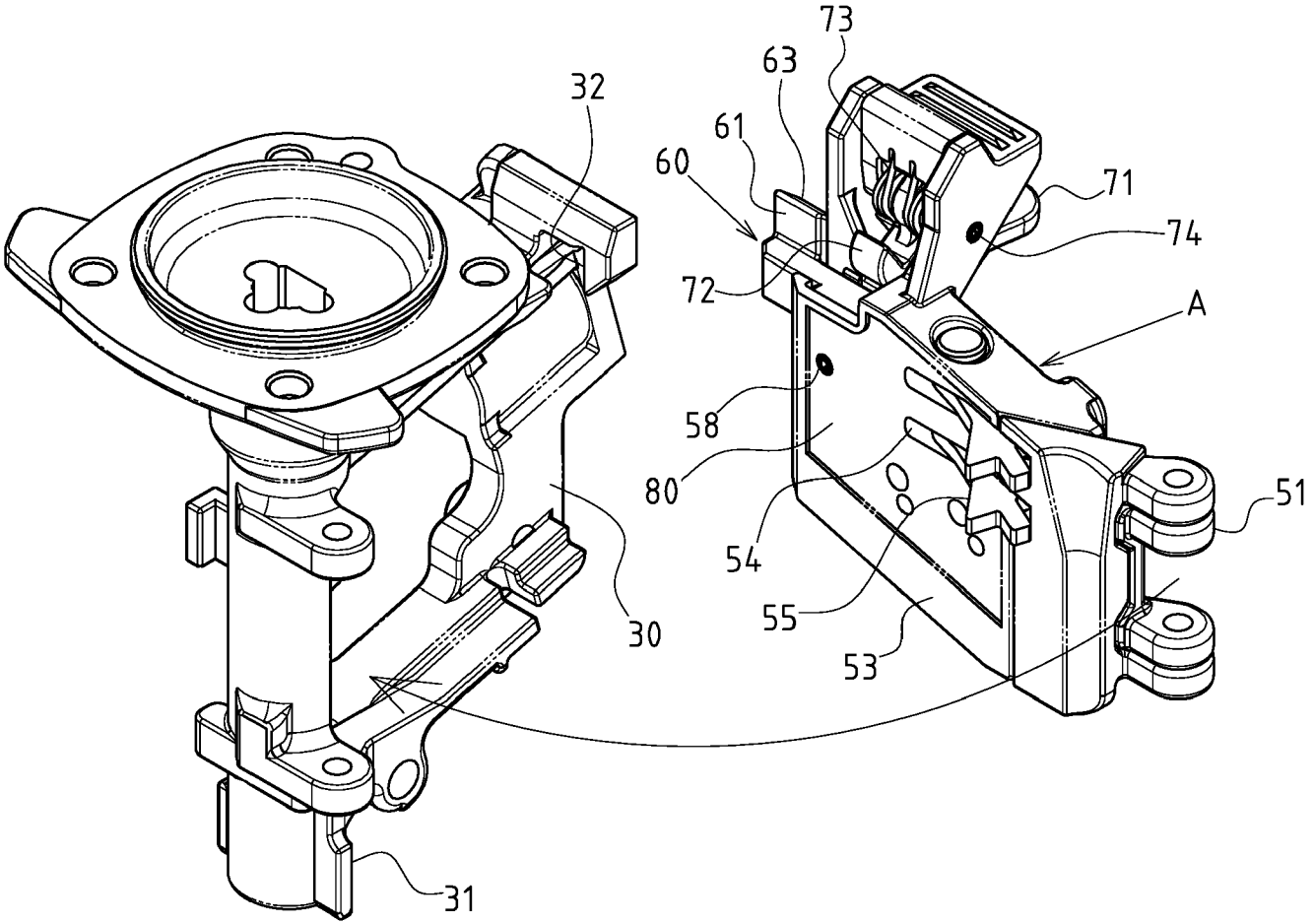
FIG. 3 shows an exploded view of the nailer body and nail presser lid of the present invention.
Figure 4:
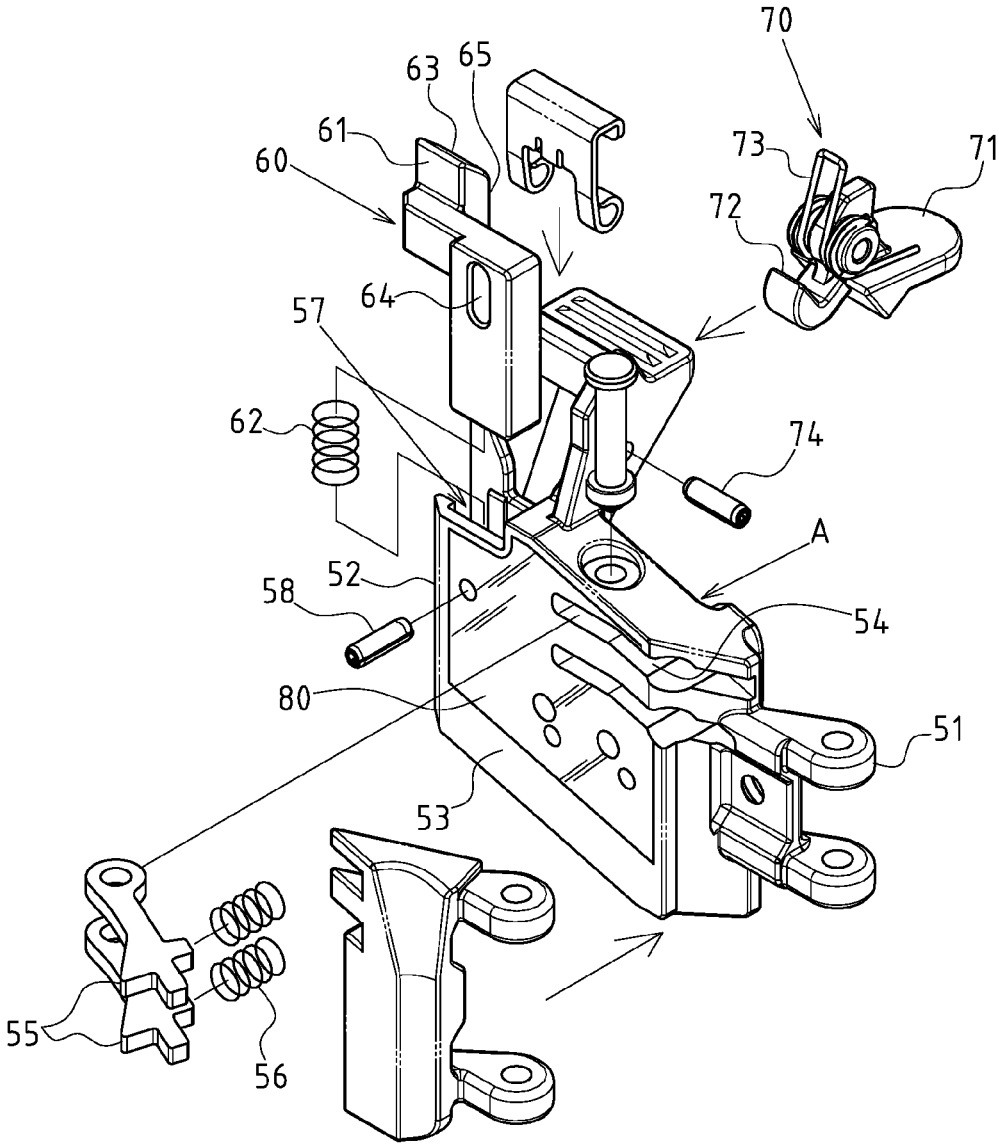
FIG. 4 shows an exploded perspective view of nail presser lid components of the present invention.
Figure 8:
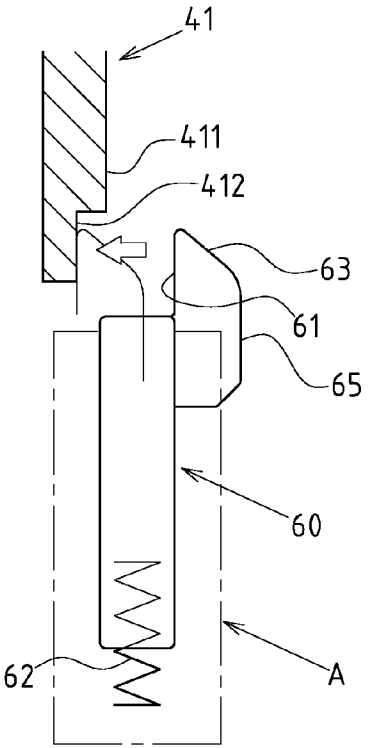
FIG. 8 shows a schematic view of the flexible presser and removable cover, showing the nail presser lid being closed first.

Referring to FIGS. 2 and 8, when removable cover 41 is closed first, and the nail presser lid A is closed second, the presser portion 61 of the flexible presser 60 on the nail presser lid A is directly pressed and overlapped on the positioning portion 412 of the closing side 411 of removable cover 41. In such a case, the removable cover 41 is positioned through the presser portion 61.

The positioning between nail presser lid A and nailer body 30 is achieved through positioning member 70, as shown in FIG. 6 and together with FIG. 2. In general, the positioning member 70 enables the snapper 72 to swing upwards via the tension of torsion spring 73, and then the positioning member 70 is fixed at opposite hook 32 of the nailer body 30, thus achieving positioning of nail presser lid A in a closing state. If the nail presser lid A is to be opened again, as shown in FIG. 7, the switch knob 71 is pulled upwards, forcing the snapper 72 to swing downwards and then separate from the hook 32, thereby opening the nail presser lid A.

Figure 10:
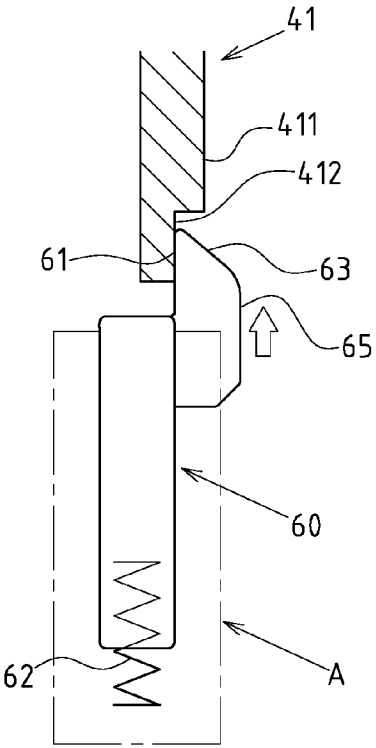
FIG. 10 shows a schematic view of the flexible presser and removable cover, showing subsequent operation of the flexible presser and removable cover as disclosed in FIG. 9.
Figure 9:
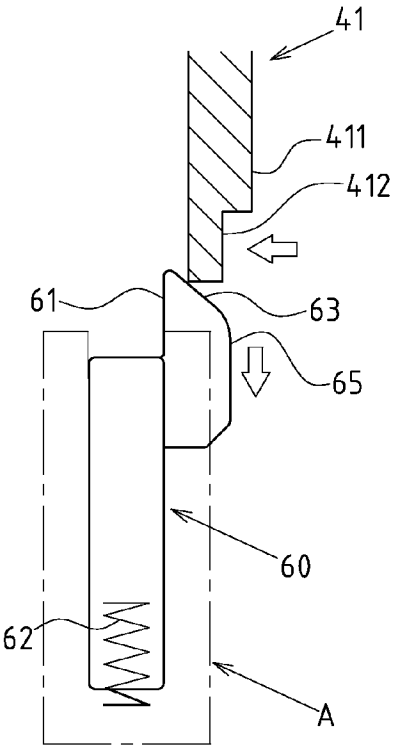
FIG. 9 shows a schematic view of the flexible presser and removable cover, showing the removable cover of the nail box being closed first.

Referring to FIG. 9, when the nail presser lid A is closed first, and the removable cover 41 is closed second, the nail presser lid A is located internally, and removable cover 41 is located externally. If the removable cover 41 presses the inclined guide plane 63 of the flexible presser 60, the presser portion 61 will return downwards and press the spring 62 to accumulate elastic restoring force. When the closing side 411 of the removable cover 41 overpasses the inclined guide plane 63, as shown in FIG. 10, the presser portion 61 will recover again and press the positioning portion of the closing side 411, such that the removable cover 41 and nail presser lid A could be overlapped and positioned as shown in FIGS. 2 and 8. In such a case, the nail presser lid A and nailer body 30 are positioned in the same manner as in FIG. 6.

Figure 11:
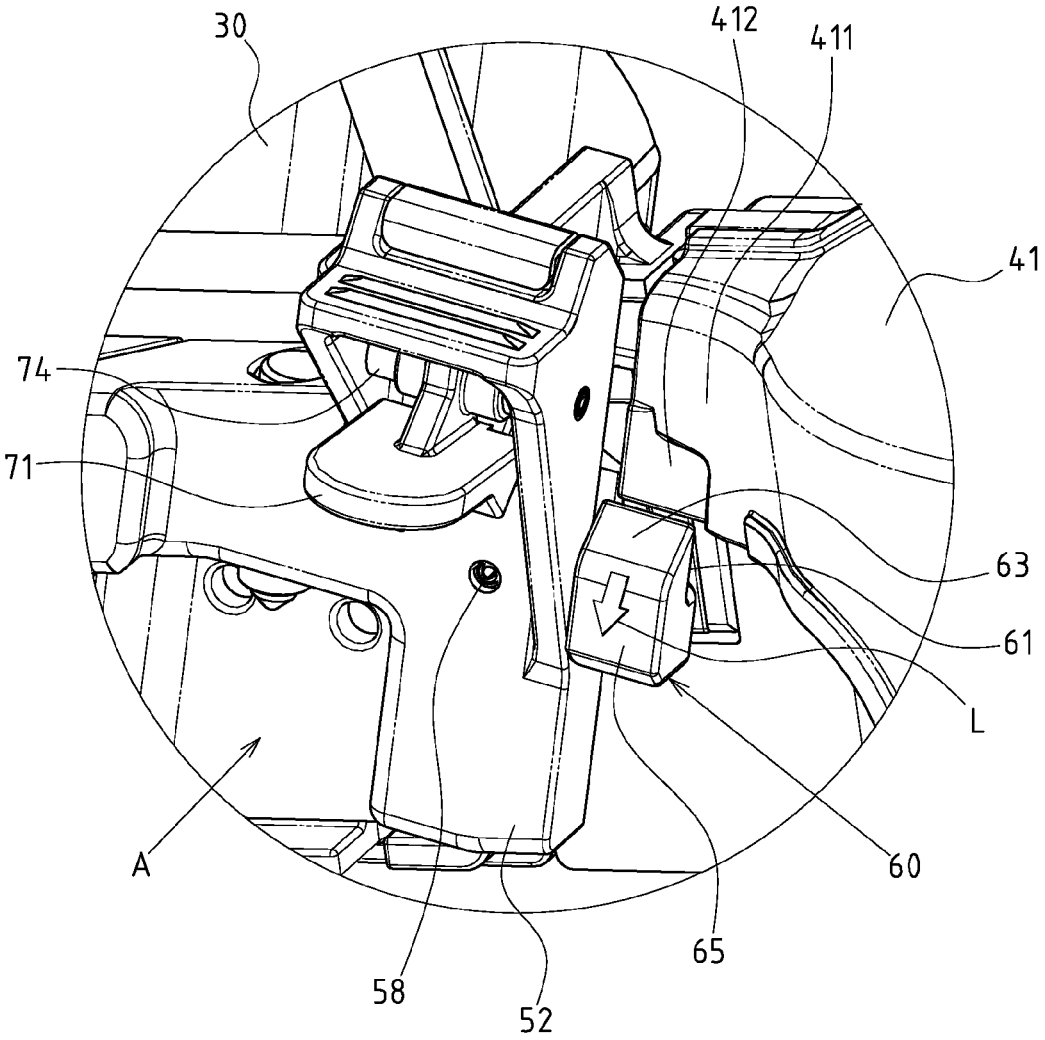
FIG. 11 shows a partial perspective view of the present invention with the presser portion of the flexible presser moving downwards.
Figure 12:
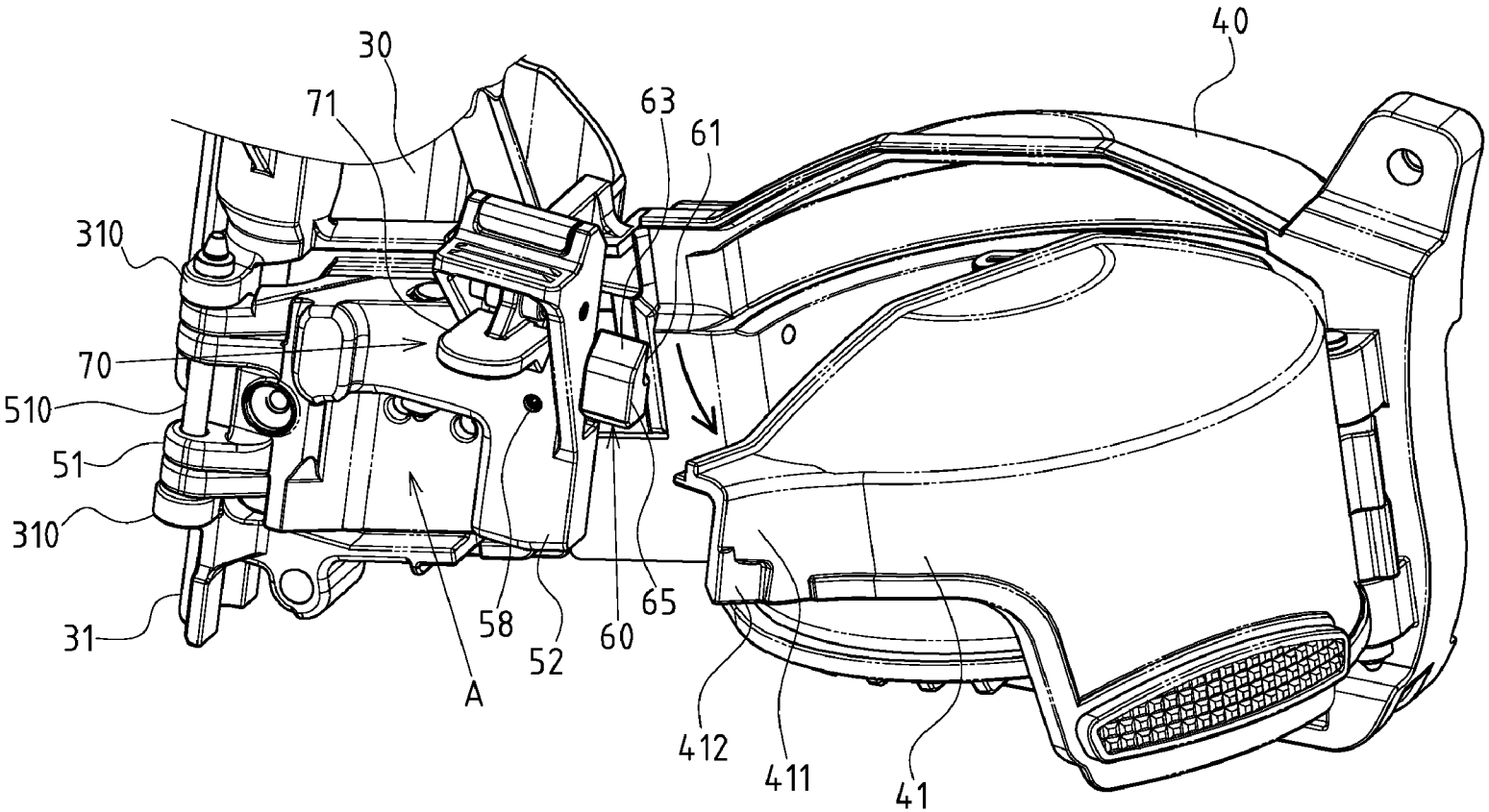
FIG. 12 shows a perspective view of the present invention in a subsequent operation after the view shown in FIG. 11, showing the removable cover released in an open state.

In addition, if the removable cover 41 is to be opened individually when the nail presser lid A and nailer body 30 are positioned, as shown in FIG. 11, the user may manually pull downwards the inclined guide plane 63 or dialing portion 65 of the flexible presser 60 (as indicated by a hollow arrow L). The presser portion 61 of the flexible presser 60 is forced to separate from the positioning portion 412 of the closing side 411, thus enabling the removable cover 41 to be opened, as shown in FIG. 12.

If the user is intended to open the nail presser lid A first, then the switch knob 71 of the positioning member 70 is pulled upwards, such that the snapper 72 is forced to swing downwards and separate from the hook 32 of nailer body 30, as shown in FIG. 7. Thus, it is possible to open the nail presser lid A first. It can thus be seen that, the nail presser lid A of the present invention and the removable cover 41 of the nailer body 30 are not limited to the opening sequence.

It can be learnt that the flexible presser 60 is formed in such a manner that the nail presser lid A and removable cover 41 of nail box 40 are flexibly closed and positioned with greater practicability and ability to operate.

Figure 13:
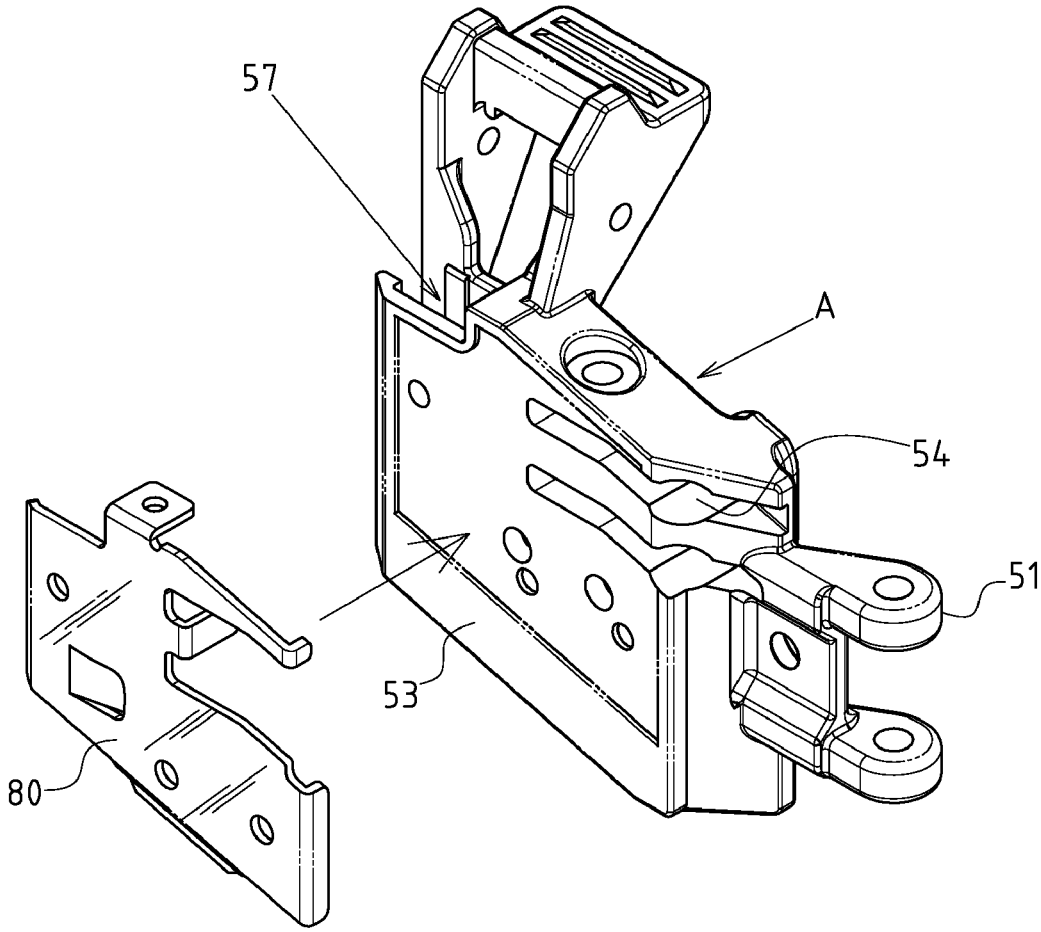
FIG. 13 shows an exploded perspective view of the present invention with a wear-resistant presser disc built into the inner surface of the nail presser lid.

Referring to FIG. 13, another important feature of the present invention is a wear-resistant presser disc 80 built in a preset location of the inner surface of the nail presser lid A. The wear-resistant presser disc 80 is made of metal materials, while the remaining portion of nail presser lid A is made of plastics. The wear-resistant presser disc 80 could be molded by an injection molding machine for stable fixing when the nail presser lid A is manufactured. This plastic significantly reduces the percentage of metal in the nail presser lid A, saving great costs. Moreover, a plastic nail presser lid A contributes to mass production by shortening the manufacturing process without need of secondary processing.

Figure 15:
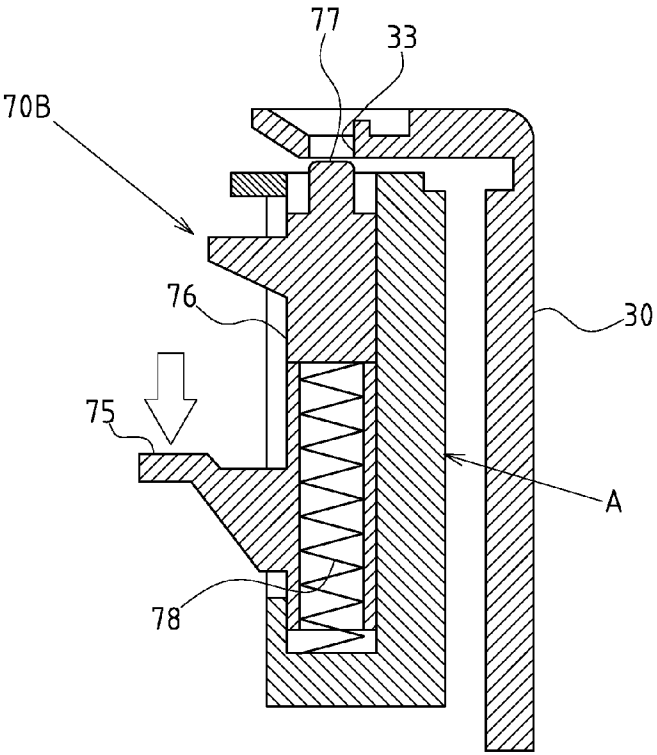
FIG. 15 shows another schematic view of the operation of positioning member, subsequent to the view of FIG. 14.
Figure 14:
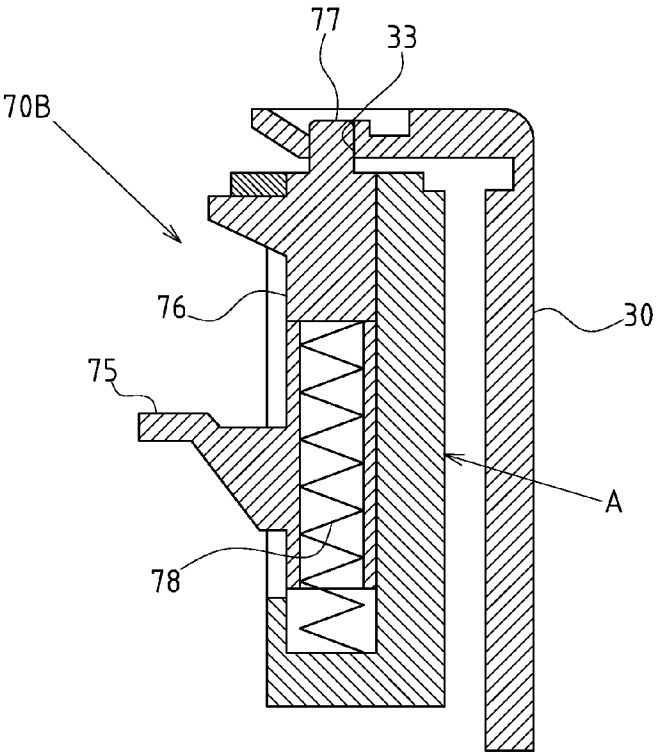
FIG. 14 shows another schematic view of the application of a positioning member of the present invention.

Furthermore, the positioning member is also available with a sliding type, as shown in FIG. 14. The positioning member 70B comprises a switch knob 75, a slider 76, a convex cylinder 77 and a spring 78. The slider 76 of the positioning member 70B is placed in a vertical groove 59 of the nail presser lid A. In a normal state, the positioning member forces the slider 76 to move up via the flexible support of spring 78, such that the convex cylinder 77 is inserted into an opposite positioning groove33 of the nailer body 30, making it possible to position the nail presser lid A in closing state. Referring also to FIG. 15, the user could make the slider 76 move downwards by pressing down the switch knob 75, such that the convex cylinder 77 could move downwards synchronously and separate from positioning groove33, thereby opening the nail presser lid A.

Additionally, the purpose of the present invention is to offer a positioning structure used for a nail presser lid and removable cover. The positioning structure comprises the aforementioned positioning portion 412 and the flexible presser 60. The positioning portion 412 could be placed at either end of the closing side 411 of removable cover 41, or swinging end 52 of the nail presser lid A. When the positioning portion 412 is placed at the closing side 411 of the removable cover 41, the flexible presser 60 could be installed at the swinging end 52 of the nail presser lid A. When the positioning portion 412 is placed at the swinging end 52 of the nail presser lid A, the flexible presser 60 could be installed at the closing side 411 of the removable cover 41.

I claim:

1. A nailing apparatus comprising:

a nailer body having a nailing portion and a nail box, said nail box having a removable cover, said removable cover having a closing side and a positioning portion; and a nail presser lid structure mounted between said nailing portion and said closing side, said nail presser lid structure comprising:

a coupling end connected to said nailing portion;

a swinging end positioned opposite said coupling end, said swinging end being rotatable about said coupling end as a pivot point;

a flexible presser affixed to said swinging end, said flexible presser having a presser portion and a spring, said spring suitable for urging said presser portion first outwardly, said presser portion protruding from said swinging end and contacting said positioning portion of said removable cover, said positioning portion having an inclined guide plane positioned outwardly therefrom; and a positioning member positioned on said swinging end and engageable with said nailer body, said removable cover being pivotally mounted to said nail box, said presser portion directly pressing onto said positioning portion when said removable cover firstly and said nail presser lid structure secondly are closed, said removable cover pressing on said inclined guide plane so as to cause said presser portion to urge against said spring when said nail presser lid structure firstly and said removable cover secondly are closed, said presser portion pressing said positioning portion so as to cause said removable cover and nail presser lid structure to be overlapped when said inclined guide plane of said removable cover overpasses said presser portion of said flexible presser.

2. The nailing apparatus of claim 1, said flexible presser having a vertical sliding block, said coupling end having a vertical chute receiving said flexible presser therein, said spring being mounted between said flexible presser and a bottom of said vertical chute.

3. The nailing apparatus of claim 2, said flexible presser having a spacing hole formed therein, said vertical chute having a pin extending through said spacing hole.

4. The nailing apparatus of claim 1, said positioning member having a toggle and a snapper at one end of said toggle, said nailer body having a hook formed thereon, said positioning member having a torsion spring urging said snapper into engagement with said hook.

5. The nailing apparatus of claim 1, said nail presser lid structure being formed of a polymeric material, said nail presser lid structure further comprising:

a wear-resistant presser disc positioned opposite to said nailer body, said presser disc being formed of a polymeric material.

6. The nailing apparatus of claim 1, said inclined guide plane having a toggle switch at one end thereof extending outwardly of said presser portion.

* * * * *